US007045050B2

(12) United States Patent
Tanaka et al.

(10) Patent No.: US 7,045,050 B2
(45) Date of Patent: May 16, 2006

(54) METHOD FOR PRODUCING ELECTROCONDUCTIVE PARTICLES

(75) Inventors: Yoshiaki Tanaka, Kyoto (JP); Nobuyuki Okinaga, Koka-gun (JP); Manabu Matsubara, Himeji (JP)

(73) Assignee: Sekisui Chemical Co., Ltd., Osaka (JP)

( * ) Notice: Subject to any disclaimer, the term of this patent is extended or adjusted under 35 U.S.C. 154(b) by 0 days.

(21) Appl. No.: 10/485,369

(22) PCT Filed: Jul. 31, 2002

(86) PCT No.: PCT/JP02/07794

§ 371 (c)(1),
(2), (4) Date: Jun. 29, 2004

(87) PCT Pub. No.: WO03/014426

PCT Pub. Date: Feb. 20, 2003

(65) Prior Publication Data

US 2004/0234683 A1 Nov. 25, 2004

(30) Foreign Application Priority Data

Jul. 31, 2001 (JP) ..... 2001-231927
Jan. 30, 2002 (JP) ..... 2002-22115

(51) Int. Cl.
*C25D 5/00* (2006.01)
*C25D 17/16* (2006.01)

(52) U.S. Cl. ..... 205/143; 204/213; 205/148; 427/222

(58) Field of Classification Search ..... 205/143, 205/148; 204/213, 214; 427/222
See application file for complete search history.

(56) References Cited

U.S. PATENT DOCUMENTS 3,494,327 A * 2/1970 Pearson ..... 118/418
5,167,779 A 12/1992 Henig
5,580,838 A * 12/1996 Patterson ..... 502/159

(Continued)

FOREIGN PATENT DOCUMENTS

EP 1 164 208 A2 12/2001

(Continued)

OTHER PUBLICATIONS

Metal Finishing Guidebook and Directory for 1975, Metals and Plastics Publications, Inc., Hackensack, N.J., 1975, pp. 376-380.*

*Primary Examiner*—Roy King
*Assistant Examiner*—William T. Leader
(74) *Attorney, Agent, or Firm*—Sughrue Mion, PLLC

(57) ABSTRACT

The purpose of the invention is to provide a method for producing conductive fine particles having a plating layer of extremely uniform thickness and free from scratches without being accompanied with agglomeration of fine particles to be plated during the plating process and a method for producing conductive fine particles comprising resin fine particles and a tin/silver alloy plating layer formed thereon.

Figure 1:
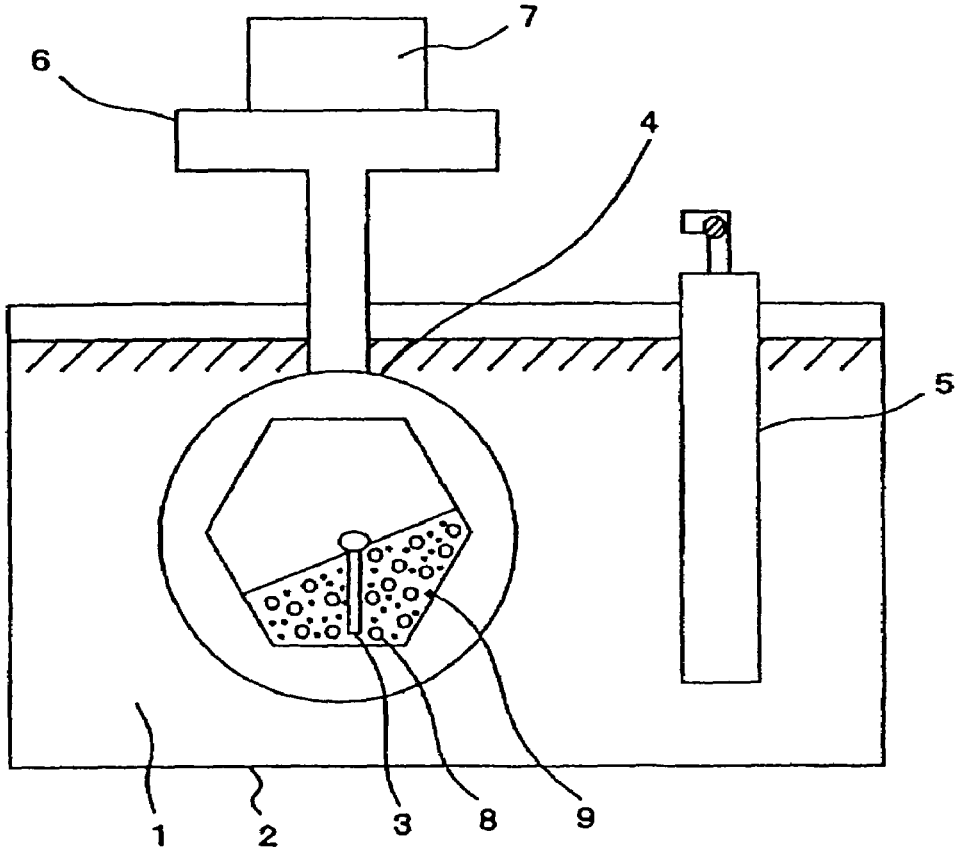

The invention is a method for producing a conductive fine particle, which comprises forming a plating layer on the surface of a fine particle to be plated using a barrel plating apparatus having a rotatable barrel in a plating bath, said method comprising putting the fine particle to be plated and a dummy particle with a lager particle diameter than that of the fine particle to be plated in the barrel and forming a plating layer while vibrating the barrel at an amplitude of 0.05 to 3.0 mm and a frequency of 20 to 120 Hz.

1 Claim, 1 Drawing Sheet

U.S. PATENT DOCUMENTS

| | | | | |
|---|---|---|---|---|
| 5,698,081 | A * | 12/1997 | Lashmore et al. | 204/212 |
| 5,965,820 | A | 10/1999 | Ogawa | |
| 6,322,685 | B1 * | 11/2001 | Kang et al. | 205/143 |
| 6,365,030 | B1 * | 4/2002 | Yoshimura et al. | 205/206 |
| 6,391,179 | B1 | 5/2002 | Ogawa | |

FOREIGN PATENT DOCUMENTS

| | | | |
|---|---|---|---|
| JP | 52147797 | | 12/1977 |
| JP | 55-119197 | A | 9/1980 |
| JP | 55119197 | | 9/1980 |
| JP | 61277104 | | 12/1986 |
| JP | 61277105 | | 12/1986 |
| JP | 62185749 | | 8/1987 |
| JP | 63190204 | | 8/1988 |
| JP | 1225776 | | 9/1989 |
| JP | 1247501 | | 10/1989 |
| JP | 4147513 | | 5/1992 |
| JP | 9-137289 | A | 5/1997 |
| JP | 9137289 | | 5/1997 |
| JP | 10-331000 | A | 12/1998 |
| JP | 10331000 | | 12/1998 |
| JP | 11-021692 | | 1/1999 |
| JP | 11-36099 | A | 2/1999 |
| JP | 11036099 | | 2/1999 |
| JP | 11200097 | | 7/1999 |
| JP | 11-279800 | | 10/1999 |
| JP | 11269692 | | 10/1999 |
| JP | 11-317416 | | 11/1999 |
| JP | 2000-021993 | | 1/2000 |
| JP | 2001-32097 | A | 2/2001 |
| JP | 2001032097 | A | 2/2001 |
| JP | 2002-069663 | | 3/2002 |
| JP | 2002-121699 | A | 4/2002 |
| JP | 2002121699 | | 4/2002 |
| WO | WO 98/46811 | | 10/1998 |
| WO | WO 98/46811 | A1 | 10/1999 |

* cited by examiner

METHOD FOR PRODUCING ELECTROCONDUCTIVE PARTICLES

TECHNICAL FIELD

The present invention relates to a method for producing conductive fine particles having a plating layer of extremely uniform thickness and free from scratches without being accompanied with agglomeration of fine particles to be plated during the plating process and relates to a method for producing conductive fine particles comprising resin fine particles and a tin/silver alloy plating layer formed thereon.

BACKGROUND ART

As a conductive material, a conductive paste, a conductive adhesive, an anisotropic conductive film and the like can be exemplified and conductive compositions containing conductive fine particles and resins are used for those conductive materials.

As such conductive fine particles, generally, metal powder, carbon powder, and fine particles plated with a metal plating layer on the surface, and the like have been used. Methods for producing conductive fine particles having metal plating layers on the surfaces are disclosed, for example, in Japanese Kokai Publication Sho-52-147797, Japanese Kokai Publication Sho-61-277104, Japanese Kokai Publication Sho-61-277105, Japanese Kokai Publication Sho-62-185749, Japanese Kokai Publication Sho-63-190204, Japanese Kokai Publication Hei-1-225776, Japanese Kokai Publication Hei-1-247501, Japanese Kokai Publication Hei-4-147513, and the like.

In these production methods, a method using a barrel plating apparatus has commonly been employed in the case of plating fine particles with a particle diameter of 5,000 μm or less. The barrel plating apparatus is for carrying out electric plating by putting an article to be plated in a rotatable polygonal or cylindrical barrel immersed in a plating solution and bringing the plated article into contact with a cathode installed in the barrel while rotating the barrel. However, the method for producing conductive fine particles using a conventional barrel plating apparatus has a problem that the fine particles to be plated are easy to be agglomerated to one another during the plating process.

On the contrary, for example, a method is proposed for forming a plating layer on a chip resistor element by loading a large number of power supplying bodies, which comprise conductive metal balls called as dummy, and a stirring promoter of ceramic balls or the like in a barrel. However, the method has a problem that an adhesion of chips to one another occur after plating and result in impossibility of separating them as independent chip parts.

Japanese Kokai Publication Hei-11-200097 proposes a barrel plating method for chip parts with considerably suppressed occurrence of the adhesion trouble of chip parts to one another by loading adjustment bodies with the same shape as that of non-conductive chip parts and a large number of metal power supplying bodies and then carrying out plating. However, according to the method, although the adhesion of chip parts can be suppressed, it is insufficient to suppress occurrence of agglomeration of fine particles when the method is applied for plating fine particles.

Meanwhile, conventionally, an alkaline cyanogen solution containing a cyanogen compound has been known as an electrolytic plating solution to be used for forming a tin/silver alloy plating layer. However, since the alkaline cyanogen solution contains a cyanogen compound, the solution has problems that it is very toxic and thus has to be handled extremely carefully; it requires particular wastewater treatment; and it worsens the work environments.

For these problems, Japanese Kokai Publication Hei-11-269692 proposes an acidic bath containing no cyanogen compound as a tin/silver alloy electrolytic plating solution and describes that it is possible to form a tin/silver alloy plating film excellent in brightness, solderability, and whisker property, using this acid bath. When electric plating is carried out using such a tin/silver alloy electrolytic plating solution, an object article to be plated is used as a cathode and a tin or an insoluble electrode is used as an anode.

However, in the case of electrically plating fine particles, the surface area of the fine particles becomes extremely wide to the quantity of the electrolytic plating solution and accordingly, the silver concentration in the electrolytic plating solution is decreased along with the proceeding of the plating and when the electric plating is continued, the tin/silver composition of the alloy differs in the thickness direction of the formed plating film and the ratio of the silver component decreases more as it goes outer and consequently, in an extreme case, it leads to a problem that the formed plating layer has an outermost layer of 100% tin.

SUMMARY OF THE INVENTION

The purpose of the invention is to provide a method for producing conductive fine particles capable of forming an even plating layer on all of fine particles to be plated without causing agglomeration of the fine particles to be plated during the plating process and a method for producing conductive fine particles capable of forming a thick plating layer of a tin/silver alloy with electrolytic plating solution containing no cyanogen compound and a plating layer with a uniform alloy composition with no difference of the alloy composition of the plating layer in the thickness direction even in the case where the surface area of an object article to be plated becomes extremely wide to the quantity of a tin/silver alloy electrolytic plating solution.

The first invention provides a method for producing a conductive fine particle, which comprises forming a plating layer on the surface of a fine particle to be plated using a barrel plating apparatus having a rotatable barrel in a plating bath, said method comprising putting the fine particle to be plated and a dummy particle with a lager particle diameter than that of the fine particle to be plated in the barrel and forming a plating layer while vibrating the barrel at an amplitude of 0.05 to 3.0 mm and a frequency of 20 to 120 Hz. It is preferable for the dummy particle to have a particle diameter of 2 to 50 times as large as that of the fine particle to be plated and a specific gravity of 1.0 to 12.0 times as heavy as that of the fine particle to be plated. Further, a feed amount of the fine particle to be plated into the barrel is preferably 10 to 60% by volume of the capacity of the barrel, a feed amount of the dummy particle into the barrel is preferably 10 to 70% by volume relative to the total of the feed amount of the fine particle to be plated and the feed amount of the dummy particle, and a volume of the mixture of the fine particle to be plated and the dummy particle fed into the barrel is preferably 10 to 60% by volume of the capacity of the barrel.

The second invention provides a method for producing a conductive fine particle, which comprises forming a tin/silver alloy plating layer on the surface of a resin fine particle plated with a metal base layer by an electrolytic plating method, said method comprising continuously or intermittently supplying a silver-containing component to an electrolytic plating solution containing a tin ion and a silver ion and carrying out electrolytic plating while keeping the silver ion concentration in the electrolytic plating solution in a constant range.

BRIEF DESCRIPTION OF THE DRAWING(S)

FIG. 1 is a schematic illustration showing one embodiment of a barrel plating apparatus to be used preferably for the first invention.

In the illustration, the reference numeral 1 represents a plating solution, 2 represents a plating bath, 3 represents a cathode lead wire, 4 represents a barrel, 5 represents an anode, 6 represents a barrel plating apparatus, 7 represents a vibrating motor, 8 represents dummy particles, and 9 represents fine particles to be plated.

DETAILED DISCLOSURE OF THE INVENTION

Hereinafter, the invention will be described more in details.

The first invention is a method for producing conductive fine particles which comprises forming a plating layer on the surface of fine particles to be plated using a barrel plating apparatus having a rotatable barrel in a plating bath.

FIG. 1 shows a schematic illustration of a cross-section of one embodiment of a barrel plating apparatus preferably used for a method for producing conductive fine particles of the first invention. In FIG. 1, barrel plating apparatus 6 comprises plating bath 2, at least a partially porous barrel 4 which is rotatable while being immersed in the plating bath 2, vibrating motor 7 for vibrating barrel 4, and anode 5. Barrel 4 is attached to a cathode installed in an end of the plating bath 2 in a detachable manner and cathode lead wire 3 to be electrically connected to the cathode is inserted into the inside of barrel 4 and installed therein. In the embodiment shown in FIG. 1, vibrating motor 7 is installed in barrel plating apparatus 6 and vibration may be applied by installing a vibrating frame and any vibrating means may be used without any limitation if it can efficiently vibrate to barrel 4. Anode 5 is immersed in plating solution 1. The cathode and anode 5 are respectively connected to rectifiers, which are not illustrated.

In the method for producing conductive fine particles of the first invention, such a barrel plating apparatus is employed to form a plating layer by putting fine particles to be plated and dummy particles with a larger particle diameter than that of the fine particles to be plated in the barrel while vibrating the barrel.

The fine particles to be plated that are supplied for the method for producing conductive fine particles of the first invention are not particularly limited and, for example, metal fine particles, organic resin fine particles, inorganic fine particles or the like can be exemplified.

The foregoing metal fine particles are not particularly limited and may include, for example, those comprising iron, copper, silver, gold, tin, lead, platinum, nickel, titanium, cobalt, chromium, aluminum, zinc, tungsten, and their alloys and the like.

The foregoing organic resin fine particles are not particularly limited and may include, for example, fine particles of straight chain polymers, fine particles of network structure polymers, fine particles of thermosetting resins, fine particles of elastic bodies, and the like.

Straight chain polymers forming the foregoing fine particles of the straight chain polymers may include, for example, nylon, polyethylene, polypropylene, methylpentene polymer, polystyrene, polymethyl methacrylate, polyvinyl chloride, polyvinyl fluoride, polytetrafluoroethylene, polyethylene terephthalate, polybutylene terephthalate, polysulfone, polycarbonate, polyacrylonitrile, polyacetal, polyamide and the like.

Network structure polymers forming the foregoing fine particles of the network structure polymers may include, for example, homopolymers of cross-linkable monomers such as divinyl benzene, hexatriene, divinyl ether, divinyl sulfone, diallyl carbinol, alkylene diacrylate, oligo or poly (alkylene glycol) diacrylate, oligo or poly(alkylene glycol) dimethacrylate, alkylene triacrylate, alkylene trimethacrylate, alkylene tetraacrylate, alkylene tetramethacrylate, alkylene bisacrylamide, alkylene bismethacrylamide and the like; and copolymers obtained by copolymerization of polymerizable monomers with these cross-linkable monomers. Among these polymerizable monomers, for example, divinylbenzene, hexatriene, divinyl ether, divinyl sulfone, alkylene triacrylate, alkylene tetraacrylate and the like are preferable.

A polymerization method of the foregoing cross-linkable monomers is not particularly limited and known synthesis methods such as a suspension polymerization method, an emulsion polymerization method, a seed polymerization method, and a dispersion polymerization method may be selected properly.

Thermosetting resins forming the foregoing fine particles of the thermosetting resins may include, for example, phenol-formaldehyde resins, melamine-formaldehyde resins, benzoguanamine-formaldehyde resins, urea-formaldehyde resins, epoxy resins, and the like.

Elastic bodies forming the foregoing fine particles of the elastic bodies may include, for example, natural rubber, synthetic rubber and the like.

The foregoing inorganic fine particles are not particularly limited and may include, for example, fine particles comprising silica, titanium oxide, iron oxide, cobalt oxide, zinc oxide, nickel oxide, manganese oxide, aluminum oxide, and the like.

Additionally, in the case where the foregoing organic resin fine particles or inorganic fine particles are used as the fine particles to be plated, those obtained by forming a conductive base layer on the surface of the foregoing organic resin fine particles or inorganic fine particles are preferably used. The foregoing conductive base layer may be formed by an electroless plating method and by other known methods for providing conductivity as well.

The foregoing dummy particles have a larger particle diameter than that of the foregoing fine particles to be plated. The particle diameter of the dummy particles is preferably 2 to 50 times as large as that of the fine particles to be plated. If it is less than 2 times, the crushing capability is insufficient to result in occurrence of agglomeration in some cases and if it is more than 50 times, not only the crushing capability is so high as to peel a plating layer formed on the fine particles to be plated but also the number of fine particles to be plated which enter in voids assumed to exist in agglomerates of the dummy particles is increased, so that agglomeration tends to be caused easily. The particle diameter is more preferably 5 to 30 times large. A plurality of types of dummy particles with different particle diameters may be used in combination as the foregoing dummy particles.

The foregoing dummy particles preferably have a specific gravity 1.0 to 12.0 times as heavy as that of the fine particles to be plated. When the dummy particles are scooped up and dropped by rotating the barrel, they tend to be buried in fine particle groups and if their specific gravity is heavier than that of the fine particles to be plated, a high stirring effect and crushing effect can be provided. If the specific gravity is less than 1.0, the crushing effect is deteriorated to result in occurrence of agglomeration in some cases and better results can be obtained as the specific gravity of the dummy particles is higher, however if the specific gravity is more than 12.0, the crushing effect becomes so high as to possibly peel the plating layer formed on the fine particles to be plated. It is more preferably 3.0 to 7.0 times.

The foregoing dummy particles may be conductive or non-conductive and conductive particles are more preferable since they can efficiently transmit electric current from the cathode lead wire to all of the fine particles to be plated. Also, conductive dummy particles and non-conductive dummy particles may be used in combination as the foregoing dummy particles.

The foregoing dummy particles are not particularly limited and may include, for example, particles of SUS (specific gravity 7.9), silicon nitride (specific gravity 3.2), alumina (specific gravity 3.6), zirconia (specific gravity 6.0), iron (specific gravity 7.9), and copper (specific gravity 8.9) and particles of these metals surface-plated with a polytetrafluoroethylene. Among them, particles made of SUS with a specific gravity of 7.9 are particularly preferable to be used.

In the method for producing conductive fine particles of the first invention, the plating layer is formed by putting the foregoing fine particles to be plated and the foregoing dummy particles in the barrel and forming plating layers while applying vibration to the barrel. In one embodiment of the invention using the barrel plating apparatus shown in FIG. 1, at first, the foregoing fine particles to be plated and the foregoing dummy particles are put into barrel 4, and while being immersed in plating solution 1 and rotated, barrel 4 is vibrated by vibrating motor 7 to carry out plating process. In this case, uneven film thickness of the plating layer can be suppressed owing to the stirring effect of the dummy particles. Agglomeration of fine particles to be plated can also be prevented owing to the crushing effect attributed to stirring of the dummy particles and vibration of the barrel. The dummy particles take a role of efficiently transmitting vibration of vibrating motor 7 to the fine particles in barrel 4.

The foregoing vibration is adjusted to have an amplitude in a range of 0.05 to 3.0 mm and a frequency in a range of 20 to 120 Hz. If the amplitude is less than 0.05 mm, the vibration cannot be transmitted well to the particles in the barrel and if it is more than 3.0 mm, the impact is so intense as to peel the plating film and particles are easily swept up, so that a bipolar phenomenon is caused to result in deterioration of the deposition of the plating layer. If the frequency is less than 20 Hz, the times of the vibration are so few as to cause agglomeration and if it is more than 120 Hz, the plating film is possibly peeled off.

The vibration may be adjusted by measuring the amplitude and frequency using, for example, an acceleration sensor and changing the vibrating force and the frequency to be proper values.

The feed amounts of the foregoing fine particles to be plated and the foregoing dummy particles into the barrel are preferably set as follows. That is, it is preferable to control the feed amount ($V_P$) of the fine particles to be plated into the barrel to be 10 to 60% by volume of the capacity ($V_B$) of the barrel, the feed amount ($V_D$) of the dummy particles into the barrel to be 10 to 70% by volume in the total ($V_P$+$V_D$) of the feed amount of the fine particles to be plated and the feed amount of the dummy particles, and the volume ($V_T$) of the mixture of the foregoing fine particles to be plated and the foregoing dummy particles fed into the barrel to be 10 to 60% by volume of the capacity of the barrel.

In general, the feed amount into the barrel is said to be proper in a range of 20 to 40% by volume of the capacity ratio in consideration of the mixing effect in the barrel and the range is preferable in the invention, too, however in the case of the invention, owing to the improvement of the mixing efficiency by loading the dummy particles and the agglomeration prevention effect of the vibration application, the feed amount may be increased up to about 60% by volume. If the feed amount ($V_P$) of the fine particles to be plated in the barrel is less than 10% by volume of the capacity ($V_B$) of the barrel, the tip end part of the cathode lead wire is naked of the agglomerates composed of the fine particles to be plated and dummy particles, so that a hydrogen gas is evolved and then leads to abrupt decrease of electric current efficiency in some cases and if the gas evolution in the barrel becomes intense, the particles are swept up, resulting in impossibility of the plating in some cases. If it is not less than 60% by volume, the mixing efficiency tends to be sharply decreased to lead to problems such as occurrence of agglomeration, widening of the unevenness of the plating film thickness. It is more preferably 15 to 45% by volume and furthermore preferably 20 to 40% by volume.

If the feed amount ($V_D$) of the dummy particles into the barrel is less than 10% by volume in the total ($V_P$+$V_D$) of the feed amount of the fine particles to be plated and the dummy particles, the probability of the occurrence of agglomeration of the fine particles to be plated tends to be increased and if it is more than 70% by volume, occurrence of plateing peeling becomes greatly frequent in some cases. It is more preferably 20 to 60% by volume and furthermore preferably 30 to 50% by volume.

If the volume ($V_T$) of the mixture of the foregoing fine particles to be plated and the foregoing dummy particles into the barrel is less than 10% by volume of the capacity of the barrel, it is very inefficient. Although it is better as the feed amount is higher, if it is more than 60% by volume, the mixing efficiency is sharply decreased to lead to problems such as occurrence of agglomeration, widening of the unevenness of the plating thickness. It is more preferably 20 to 45% by volume.

In addition, the total ($V_P$+$V_D$) of the feed amount of the fine particles to be plated and the dummy particles, and the volume ($V_T$) of the mixture of the fine particles to be plated and the foregoing dummy particles loaded into the barrel satisfy the relation defined by the following mathematical formula:

$$V_T<(V_P+V_D).$$

That is understood from that since the dummy particles are larger than the fine particles to be plated and the fine particles to be plated enter in voids among the dummy particles when they are mixed, the volume of the mixture becomes smaller than the total volume calculated simply by adding the feed amounts. Accordingly, $V_T$ has to be measured by experimental measurement.

In the method for producing conductive fine particles of the first invention, the plating layer to be formed on the surface of the foregoing fine particles to be plated is not particularly limited and may include plating layers comprising metals such as gold, silver, copper, platinum, zinc, iron, lead, tin, aluminum, cobalt, indium, nickel, chromium, titanium, antimony, bismuth, germanium, cadmium, and silicon. These metals may be used alone or in combination of two or more of them.

According to the method for producing conductive fine particles of the first invention, conductive fine particles having a plating layer with extremely even thickness and free from scratches can be produced without being accompanied with agglomeration of the fine particles to be plated during the plating process.

The method for producing conductive fine particles of the second invention is a method for forming a tin/silver alloy plating layer on the surface of resin fine particles plated with a metal base layer by an electrolytic plating method.

The resin fine particles to be supplied for the method for producing the conductive fine particles of the second invention are not particularly limited and may include the organic resin fine particles as same as the resin fine particles to be supplied for the method for producing conductive fine particles of the first invention and hybrid fine particles of organic resin fine particles and inorganic fine particles. It is preferable for these resin fine particles to be previously plated with a metal base layer on the surface. The foregoing metal base layer is not particularly limited if it improves the adhesion strength between the resin fine particles and the tin/silver alloy plating layer and may include platings comprising a simple substance of metal such as iron, copper, silver, gold, tin, lead, platinum, nickel, titanium, cobalt, chromium, aluminum, zinc and tungsten, or their alloys. The foregoing metal base layer may be formed by, for example, an electroless plating method and other known methods for providing conductivity as well.

Since the foregoing tin/silver alloy plating layer is required to be melted at the time of mounting of electronic parts, it is preferable to have a low melting point to suppress the damages on other electronic parts by heat. In order to lower the melting point of the foregoing tin/silver alloy plating layer, it is preferable to form an eutectic plating layer. The content of silver in the eutectic plating layer is generally about 3.5% by weight. Since an electrolytic plating solution containing tin ion in an excess amount as compared with that of silver ion is used in order to obtain such an eutectic plating layer of the tin/silver alloy, it is required to keep the silver ion concentration in a constant concentration range.

The method for producing the conductive fine particles of the second invention is a method for producing a conductive fine particle, which comprises forming a tin/silver alloy plating layer on the surface of a resin fine particle plated with a metal base layer by an electrolytic plating method, said method comprising continuously or intermittently supplying a silver-containing component to an electrolytic plating solution containing a tin ion and a silver ion and carrying out electrolytic plating while keeping the silver ion concentration in the electrolytic plating solution in a constant range.

The foregoing electrolytic plating solution contains a tin compound as a tin-containing component and a silver compound as a silver-containing component, respectively, dissolved therein.

Tin compounds as the foregoing tin compound are not particularly limited if they can release a tin ion in an acidic bath and may include, for example, stannous oxide, stannous sulfate, tin chloride, tin sulfide, tin iodide, tin citrate, tin oxalate, stannous acetate and the like. They may be used alone and in combination of two or more of them.

Silver compounds as the foregoing silver compound are not particularly limited if they can release a silver ion in an acidic bath and may include, for example, silver oxide, silver sulfate, silver chloride, silver nitrate and the like. They may be used alone and in combination of two or more of them.

The foregoing electrolytic plating solution may contain, as complexing agents for tin and silver, compounds of such as aminothiophenol type, thiourea type, thilazole type, sulphene amide type, thiuram type, dithiocarbamic acid type, bisphenol type, benzimidazole type, organic thio acid type. Addition of such complexing agents makes it possible to stably dissolve a tin ion and a silver ion for a long period.

The foregoing electrolytic plating solution may contain an unsaturated aliphatic aldehyde in order to improve the brightness and solderability and may contain also an amine compound together with an unsaturated aliphatic aldehyde. Further, additives such as a brightener, and a leveling agent may also be used in combination.

To carry out the method for producing conductive fine particles of the second invention, the entire surface area of the resin fine particles to be plated is calculated from the weight of the resin fine particles loaded in a plating apparatus. From the calculated entire surface area of the resin fine particles, the initial concentrations of a tin ion and a silver ion contained in the foregoing electrolytic plating solution are properly determined. Next, the decrease degree of the concentration of a silver ion consumed for the electrolytic plating per unit time is theoretically calculated.

In the electrolytic plating, if the decrease degree of the concentration of a silver ion contained in the electrolytic plating solution is more than 15% of the initial concentration, it becomes difficult to form a plating layer with a uniform tin/silver alloy composition. Accordingly, before the concentration of a silver ion contained in the electrolytic plating solution decreases by 15% or more of the initial concentration, it is preferable to supplement the foregoing silver compound as a silver-containing component to the electrolytic plating solution. In this case, when the foregoing silver compound is supplemented, it is preferable to set standardized times and period for supplementing the foregoing silver compound to the electrolytic plating solution on the basis of the previous measurement of the decrease of the silver ion concentration in the electrolytic plating solution with lapse of time. Further, it is also preferable to supplement the silver compound by intermittently or continuously measuring the silver ion concentration in the electrolytic plating solution and thereby monitoring the silver ion concentration during the electrolytic plating. In order to supplement the electrolytic plating solution, for example, a method which comprises installing a supplementing tank for intermittently supplying the electrolytic plating solution to the electrolytic bath, storing an electrolytic plating solution containing the foregoing silver compound in the supplementing tank, and supplementing the solution to the electrolytic bath based on necessity, or the like is exemplified.

Electrolytic plating apparatus to be employed for the method for producing the conductive fine particles of the second invention is not particularly limited and, for example, the above-mentioned barrel plating apparatus, or the like is preferable. In this case, the conductive fine particles may be produced by the method for producing the conductive fine particles of the first invention.

According to the method for producing the conductive fine particles of the second invention, conductive fine particles comprising resin fine particles plated with a tin/silver alloy plating layer with a uniform composition on the surface can be produced.

The conductive fine particles produced by the method for producing the conductive fine particles of the invention may be used preferably for connecting a semiconductor chip and an electronic part to a mounting substrate and also as a conductive paste, a conductive adhesive, an anisotropic conductive film and the like. In this case, the particle diameter of the conductive fine particles is preferably 10 to 1000 μm, more preferably 50 to 800 μm, and furthermore preferably 200 to 800 μm.

BEST MODE FOR CARRYING OUT THE INVENTION

Hereinafter, the invention will be described more in details with reference to Examples, however it is not intended that the invention be limited to the illustrated Examples.

EXAMPLE 1

Synthetic resin fine particles obtained by copolymerization of styrene and divinyl benzene were plated with a nickel plating and a copper plating as a conductive base layer to obtain copper-plated fine particles with an average particle diameter of 762.3 μm with a standard deviation of 10.5 μm. The copper-plated fine particles had a specific gravity of 1.59.

Using a plating apparatus (barrel capacity of 2.4 L) shown in FIG. 1, the obtained copper-plated fine particles were used as the fine particles to be plated and subjected to plating with a solder. As dummy particles, ϕ12 balls (specific gravity of 7.9) made of SUS were used. The fine particles to be plated and the dummy particles were loaded into the barrel so as to adjust the feed amount of the fine particles to be plated into the barrel to be 24% by volume of the capacity of the barrel and the feed amount of the dummy particles into the barrel to be 40% by volume of the total of the feed amounts of the fine particles to be plated and the dummy particles. In this case, the volume of the mixture of the loaded fine particles to be plated and dummy particles was found to be 34% by volume by measurement. The ratio (the size ratio) of the particle diameter of the dummy particles to that of the fine particles to be plated was 15.7 and the ratio (the specific gravity ratio) of the specific gravity of the dummy particles to that of the fine particles to be plated was 5.0. A vibrating motor with the maximum vibrating power of 800 N and a frequency of 60 Hz was employed. The vibration of the barrel was measured by an acceleration sensor to find that the double amplitude was 0.6 mm and the frequency was 60 Hz. Plating was carried out at 0.25 A/dm$^2$ of current density and 15 rpm of rotation frequency for about 3 hours to obtain conductive fine particles having a solder plating in the outermost layer.

When the obtained conductive fine particles were sieved by a sieve with 810 μm meshes, 100% of the particles were passed through. The average particle diameter and the thickness of the solder plating layer of 300 particles of the obtained conductive fine particles were 804.9 μm and 21.3 μm, respectively.

The obtained conductive fine particles in a number of 1,000 were observed by an optical microscope and the ratio of agglomerated particles and the ratio of particles having a peeling were calculated and further, evaluation was carried out on the following criteria.

◎: both of agglomeration and peeling is 0%

○: agglomeration and peeling is less than 50%

X: agglomeration and peeling is 50% or higher

The results are shown in Table 1.

EXAMPLES 2 to 24, COMPARATIVE EXAMPLES 1 to 11

Conductive fine particles were produced in the same manner as described in Example 1, except that the particle diameters of fine particles to be plated, the types and the particle diameters of the dummy particles, and the feed amounts were changed as shown in Table 1 and Table 2 and subjected to same evaluation.

As dummy particles, steel balls plated with nickel on the surface were used for Examples 3, 10, and 11 and Comparative Example 2 and column-like stainless particles were used for Example 6, and resin fine particles plated with copper on the surface were used for Example 8.

In Tables, the particle diameter ratio represents (particle diameter of dummy particles)/(particle diameter of fine particles to be plated); the specific gravity ratio represents (specific gravity of dummy particles)/(specific gravity of fine particles to be plated); the feed amount of fine particles to be plated represents {(feed amount of fine particles to be plated)/barrel capacity}×100; the feed amount of dummy particles represents {(feed amount of dummy particles)/(feed amount of fine particles to be plated+feed amount of dummy particles)}×100; the volume of the mixture represents {(the volume of the mixed fine particles to be plated and dummy particles)/barrel capacity}×100.

The results are shown in Table 1 and Table 2.

TABLE 1

| | Fine particles to be plated | | Dummy particles | | | Particle ratio | |
|---|---|---|---|---|---|---|---|
| | Particle diameter (μm) | Specific gravity | Type | Particle diameter (mm) | Specific gravity | Particle diameter ratio | Specific gravity ratio |
| Example 1 | 762.3 | 1.59 | Stainless steel | 12 | 7.9 | 15.7 | 5.0 |
| Example 2 | 762.3 | 1.59 | Stainless steel | 4 | 7.9 | 5.2 | 5.0 |
| Example 3 | 762.3 | 1.59 | Steel + Ni | 2 | 7.9 | 2.6 | 5.0 |
| Example 4 | 762.3 | 1.59 | Stainless steel | 35 | 7.9 | 45.9 | 5.0 |
| Example 5 | 270 | 1.74 | Stainless steel | 6 | 7.9 | 22.2 | 4.5 |
| Example 6 | 270 | 1.74 | Stainless steel (column type) | 5 | 7.9 | 18.5 | 4.5 |
| Example 7 | 270 | 1.74 | Teflon | 5 | 2.2 | 18.5 | 1.3 |
| Example 8 | 84 | 1.35 | Resin + Cu | 0.27 | 1.74 | 3.2 | 1.3 |
| Example 9 | 84 | 1.35 | Stainless steel | 3 | 7.9 | 35.7 | 5.9 |
| Example 10 | 44 | 2.94 | Steel + Ni | 1 | 7.9 | 22.7 | 2.7 |

TABLE 1-continued

| | | | | | | | |
|---|---|---|---|---|---|---|---|
| Example 11 | 44 | 2.94 | Steel + Ni | 0.5 | 7.9 | 11.4 | 2.7 |
| Example 12 | 270 | 1.74 | Stainless steel | 6 | 7.9 | 22.2 | 4.5 |
| Example 13 | 270 | 1.74 | Stainless steel | 6 | 7.9 | 22.2 | 4.5 |
| Example 14 | 270 | 1.74 | Stainless steel | 6 | 7.9 | 22.2 | 4.5 |
| Example 15 | 270 | 1.74 | Stainless steel | 6 | 7.9 | 22.2 | 4.5 |
| Example 16 | 270 | 1.74 | Stainless steel | 6 | 7.9 | 22.2 | 4.5 |
| Example 17 | 270 | 1.74 | Stainless steel | 6 | 7.9 | 22.2 | 4.5 |
| Example 18 | 270 | 1.74 | Stainless steel | 6 | 7.9 | 22.2 | 4.5 |
| Example 19 | 270 | 1.74 | Stainless steel | 6 | 7.9 | 22.2 | 4.5 |
| Example 20 | 270 | 1.74 | Stainless steel | 6 | 7.9 | 22.2 | 4.5 |
| Example 21 | 270 | 1.74 | Stainless steel | 6 | 7.9 | 22.2 | 4.5 |
| Example 22 | 270 | 1.74 | Stainless steel | 6 | 7.9 | 22.2 | 4.5 |
| Example 23 | 270 | 1.74 | Stainless steel | 6 | 7.9 | 22.2 | 4.5 |
| Example 24 | 270 | 1.74 | Stainless steel | 6 | 7.9 | 22.2 | 4.5 |

| | Feed amount | | | | Evaluation | | |
|---|---|---|---|---|---|---|---|
| | Barrel capacity (ml) | Feed amount of fine particles to be plated (% by volume) | Feed amount of dummy particles (% by volume) | Volume of the mixture (% by volume) | Agglomeration (%) | Peeling (%) | Evaluation |
| Example 1 | 2400 | 24 | 40 | 34 | 0 | 0 | ◎ |
| Example 2 | 2400 | 24 | 40 | 34 | 0 | 0 | ◎ |
| Example 3 | 2400 | 24 | 40 | 34 | 14 | 0 | ○ |
| Example 4 | 2400 | 24 | 40 | 34 | 0 | 31 | ○ |
| Example 5 | 700 | 24 | 40 | 34 | 0 | 0 | ◎ |
| Example 6 | 700 | 24 | 40 | 34 | 0 | 0 | ◎ |
| Example 7 | 700 | 24 | 40 | 34 | 24 | 0 | ○ |
| Example 8 | 250 | 24 | 40 | 34 | 24 | 0 | ○ |
| Example 9 | 250 | 24 | 40 | 34 | 3 | 12 | ○ |
| Example 10 | 250 | 24 | 40 | 34 | 39 | 9 | ○ |
| Example 11 | 250 | 24 | 40 | 34 | 46 | 3 | ○ |
| Example 12 | 700 | 10 | 40 | 14 | 0 | 27 | ○ |
| Example 13 | 700 | 15 | 40 | 21 | 0 | 5 | ○ |
| Example 14 | 700 | 20 | 40 | 28 | 0 | 0 | ◎ |
| Example 15 | 700 | 40 | 40 | 56 | 0 | 0 | ◎ |
| Example 16 | 700 | 45 | 35 | 60 | 8 | 0 | ○ |
| Example 17 | 700 | 55 | 10 | 60 | 47 | 0 | ○ |
| Example 18 | 700 | 24 | 10 | 26 | 28 | 0 | ○ |
| Example 19 | 700 | 24 | 20 | 28 | 5 | 0 | ○ |
| Example 20 | 700 | 24 | 30 | 30 | 0 | 0 | ◎ |
| Example 21 | 700 | 24 | 40 | 34 | 0 | 0 | ◎ |
| Example 22 | 700 | 24 | 50 | 38 | 0 | 0 | ◎ |
| Example 23 | 700 | 24 | 60 | 46 | 0 | 6 | ○ |
| Example 24 | 700 | 24 | 70 | 58 | 0 | 17 | ○ |

TABLE 2

| | Fine particles to be plated | | Dummy particles | | | Particle ratio | |
|---|---|---|---|---|---|---|---|
| | Particle diameter (μm) | Specific gravity | Type | Particle diameter (mm) | Specific gravity | Particle diameter ratio | Specific gravity ratio |
| Comparative Example 1 | 762.3 | 1.59 | Stainless steel | 45 | 7.9 | 59.0 | 5.0 |
| Comparative Example 2 | 762.3 | 1.59 | Steel + Ni | 0.5 | 7.9 | 65.5 | 5.0 |
| Comparative Example 3 | 270 | 1.74 | Polyamide | 5 | 1.14 | 18.5 | 0.7 |
| Comparative Example 4 | 270 | 1.74 | Stainless steel | 6 | 7.9 | 22.2 | 4.5 |
| Comparative Example 5 | 270 | 1.74 | Stainless steel | 6 | 7.9 | 22.2 | 4.5 |
| Comparative Example 6 | 270 | 1.74 | Stainless steel | 6 | 7.9 | 22.2 | 4.5 |
| Comparative | 270 | 1.74 | Stainless steel | 6 | 7.9 | 22.2 | 4.5 |

TABLE 2-continued

| | | | | | | | |
|---|---|---|---|---|---|---|---|
| Example 7 | | | | | | | |
| Comparative Example 8 | 270 | 1.74 | Stainless steel | 6 | 7.9 | 22.2 | 4.5 |
| Comparative Example 9 | 270 | 1.74 | Stainless steel | 6 | 7.9 | 22.2 | 4.5 |
| Comparative Example 10 | 270 | 1.74 | Stainless steel | 6 | 7.9 | 22.2 | 4.5 |
| Comparative Example 11 | 270 | 1.74 | Stainless steel | 6 | 7.9 | 22.2 | 4.5 |

| | Feed amount | | | | Evaluation | | |
|---|---|---|---|---|---|---|---|
| | Barrel capacity (ml) | Feed amount of fine particles to be plated (% by volume) | Feed amount of dummy particles (% by volume) | Volume of the mixture (% by volume) | Agglomeration (%) | Peeling (%) | Evaluation |
| Comparative Example 1 | 2400 | 24 | 40 | 34 | 0 | 76 | X |
| Comparative Example 2 | 2400 | 24 | 40 | 34 | 93 | 0 | X |
| Comparative Example 3 | 700 | 24 | 40 | 34 | 94 | 0 | X |
| Comparative Example 4 | 700 | 5 | 0 | 5 | Impossibility of plating | — | X |
| Comparative Example 5 | 700 | 5 | 40 | 7 | Impossibility of plating | — | X |
| Comparative Example 6 | 700 | 65 | 0 | 65 | 100 | 0 | X |
| Comparative Example 7 | 700 | 24 | 5 | 25 | 77 | 0 | X |
| Comparative Example 8 | 700 | 24 | 75 | 67 | 0 | 72 | X |
| Comparative Example 9 | 700 | 60 | 40 | 84 | 81 | 12 | X |
| Comparative Example 10 | 700 | 10 | 80 | 34 | 0 | 95 | X |
| Comparative Example 11 | 700 | 40 | 0 | 40 | 95 | 0 | X |

EXAMPLE 25

Synthetic resin fine particles obtained by copolymerization of styrene and divinyl benzene were plated with a nickel plating as a conductive base layer to obtain nickel-plated fine particles with an average particle diameter of 264.0 μm with a standard deviation of 1.68 μm. The nickel-plated fine particles had a specific gravity of 1.24.

The nickel-plated fine particles were fed to a regular hexagonal barrel of 700 mL capacity of a barrel plating apparatus and electrolytic copper plating was carried out. As dummy particles, ϕ4 balls (specific gravity of 7.9) made of SUS were used. The fine particles to be plated and the dummy particles were loaded into the barrel so as to adjust the feed amount of the fine particles to be plated in the barrel to be 24% by volume of the capacity of the barrel and the feed amount of the dummy particles into the barrel to be 40% by volume of the total of the feed amounts of the fine particles to be plated and the dummy particles. In this case, the volume of the mixture of the loaded fine particles to be plated and dummy particles was found to be 34% by volume by measurement. The ratio (the particle diameter ratio) of the particle diameter of the dummy particles to that of the fine particles to be plated was 15.2 and the ratio (the specific gravity ratio) of the specific gravity of the dummy particles to that of the fine particles to be plated was 6.4. A vibrating motor with the maximum vibrating power of 350 N and a frequency of 50 Hz was employed. The vibration of the barrel was measured by an acceleration sensor to find that the double amplitude was 0.2 mm and the frequency was 50 Hz. Plating was carried out at 0.25 A/dm$^2$ of current density and 15 rpm of rotation frequency to obtain conductive fine particles having a copper plating layer in the outermost layer. The average particle diameter and the thickness of the copper plating layer of 300 particles of the obtained conductive fine particles were 270.2 μm and 3.1 μm, respectively.

The obtained conductive fine particles were subjected to the same evaluation as that in Example 1.

The results are shown in Table 3.

EXAMPLES 26 to 27, COMPARATIVE EXAMPLE 12

Conductive fine particles were produced in the same manner as described in Example 25, except that, for the dummy particles, alumina was used for Example 26, tungsten carbide steel was used for Example 27, and tungsten was used for Comparative Examples 12.

The results are shown in Table 3.

TABLE 3

| | Fine particles to be plated | | Dummy particles | | | Particle ratio | |
|---|---|---|---|---|---|---|---|
| | Particle diameter (μm) | Specific gravity | Type | Particle diameter (mm) | Specific gravity | Particle diameter ratio | Specific gravity ratio |
| Example 25 | 264 | 1.24 | Stainless steel | 4 | 7.9 | 15.2 | 6.4 |
| Example 26 | 264 | 1.24 | Alumina | 5 | 3.9 | 18.9 | 3.1 |
| Example 27 | 264 | 1.24 | Tungsten carbide steel | 5 | 14.8 | 18.9 | 11.9 |
| Comparative Example 12 | 264 | 1.24 | Tungsten | 5 | 19 | 18.9 | 15.3 |

| | Feed amount | | | | Evaluation | | |
|---|---|---|---|---|---|---|---|
| | Barrel capacity (ml) | Feed amount of fine particles to be plated (% by volume) | Feed amount of dummy particles (% by volume) | Volume of the mixture (% by volume) | Agglomeration (%) | Peeling (%) | Evaluation |
| Example 25 | 700 | 24 | 40 | 34 | 0 | 0 | ◎ |
| Example 26 | 700 | 24 | 40 | 34 | 0 | 0 | ◎ |
| Example 27 | 700 | 24 | 40 | 34 | 0 | 22 | ○ |
| Comparative Example 12 | 700 | 24 | 40 | 34 | 0 | 68 | X |

EXAMPLE 28

Resin fine particles (called as copper-plated resin fine particles) obtained by forming a copper plating layer as a metal base layer on the surface of resin fine particles of 168 mL were loaded in a regular pentagonal barrel of 700 mL capacity of a barrel plating apparatus and subjected to electrolytic plating to obtain conductive fine particles having an eutectic plating layer of a tin/silver alloy on the surface of the copper plating layer.

The total surface area of the copper-plated resin fine particles was 201.3 $dm^2$ and the ratio of the copper-plated resin fine particles in the barrel was 24% by volume. The copper-plated resin fine particles were found having an average particle diameter of 264.5 μm with a standard deviation of 3.0 μm.

An electrolytic plating solution of 150 L used in this case was produced by dissolving a tin compound and a silver compound so as to adjust the tin ion concentration and the silver ion concentration to be 23.0 g/L and 0.27 g/L, respectively.

While the barrel being immersed in the electrolytic plating solution put in an electrolytic bath and rotated therein, electrolytic plating was carried out under the conditions of 0.25 $A/dm^2$ of current density and 15 rpm of the rotation speed of the barrel for 158 minutes. Under the plating conditions, if the silver content in the tin/silver alloy plating layer was 3.5% by weight, which is the content of an eutectic composition, the amount of silver precipitated from the electrolytic plating solution reached 0.066 g/minute. Therefore, the plating was carried out while the silver compound in an amount of 1.04 g on the basis of silver ion was supplemented every 15.8 minute. In the entire plating process for 158 minutes, supplementation of the electrolytic plating solution was carried out 9 times in the total and the total supplementation amount on the basis of silver was 9.36 g.

During the plating process, a slight amount of the conductive fine particles were sampled after 15.8 minutes, 39.5 minutes, 79.0 minutes, and 118.6 minutes from the starting of the electrolytic plating and the thickness (μm) of the formed plating layer and the silver content (% by weight) were measured and the results are shown in Table 4 and Table 5. In addition, the thickness of the plating layer was measured from cross-sectional microphotographs and the silver content in the plating layer was measured by atomic absorption spectrophotometry, respectively.

COMPARATIVE EXAMPLES 13

Conductive fine particles of copper-plated resin fine particles plated with a tin/silver alloy plating layer on the surface were produced by carrying out electrolytic plating in the same manner as described in Example 4, except that the silver compound was not at all supplemented to the electrolytic plating solution.

During the above-mentioned plating process, a slight amount of the conductive fine particles were sampled in the same manner as Example 28 and the thickness of the formed plating layer and the silver content were measured and the results are shown in Table 4 and Table 5.

TABLE 4

| | | Plating duration (minute) | | | | |
|---|---|---|---|---|---|---|
| | | 15.8 | 39.5 | 79.0 | 118.6 | 158.1 |
| Example 28 | Thickness of plating layer (theoretical value, μm) | 2 | 5 | 10 | 15 | 20 |

TABLE 4-continued

| | | Plating duration (minute) | | | | |
|---|---|---|---|---|---|---|
| | | 15.8 | 39.5 | 79.0 | 118.6 | 158.1 |
| | Thickness of plating layer (measured value, μm) | 1.6 | 3.9 | 7.8 | 11.6 | 15.2 |
| | Silver content in plating layer (% by weight) | 3.4 | 3.6 | 3.5 | 3.6 | 3.6 |
| Comparative Example 13 | Thickness of plating layer (theoretical value, μm) | 2 | 5 | 10 | 15 | 20 |
| | Thickness of plating layer (measured value, μm) | 1.5 | 3.8 | 7.6 | 11.4 | 15.0 |
| | Silver content in plating layer (% by weight) | 3.5 | 3.0 | 2.7 | 2.2 | 1.7 |

TABLE 5

| | Silver content in plating layer (% by weight) | |
|---|---|---|
| | Example 28 | Comparative Example 13 |
| Plating layer precipitated after 15.8 minutes | 3.4 | 3.5 |
| Plating layer precipitated in a period from 15.8 to 39.5 minutes | 3.7 | 2.7 |
| Plating layer precipitated in a period from 39.5 to 79.0 minutes | 3.4 | 2.4 |
| Plating layer precipitated in a period from 79.0 to 118.6 minutes | 3.8 | 1.2 |
| Plating layer precipitated in a period from 118.6 to 158.1 minutes | 3.6 | 0.1 |

INDUSTRIAL APPLICABILITY

According to the invention, a method for producing conductive fine particles having a plating layer of extremely uniform thickness and free from scratches without being accompanied with agglomeration of fine particles to be plated during the plating process and a method for producing conductive fine particles comprising resin fine particles and a tin/silver alloy plating layer formed on the surface are provided.

The invention claimed is:

1. A method for producing a conductive fine particle, which comprises forming a plating layer on the surface of an organic resin fine particle having a conductive base layer on the surface using a barrel plating apparatus having a rotatable barrel in a plating bath, said method comprising putting the organic resin fine particle and a dummy particle in the barrel and forming a plating layer while vibrating the barrel at an amplitude of 0.05 to 3.0 mm and a frequency of 20 to 120 Hz, wherein the organic resin fine particle is made of at least one resin selected from the group consisting of network structure polymer, thermosetting resin and elastic body, wherein the dummy particle has a particle diameter of 2 to 50 times as large as that of the organic resin fine particle and a specific gravity of 1.0 to 12.0 times as heavy as that of the organic resin fine particle, wherein a feed amount of the fine particle to be plated into the barrel is 10 to 60% by volume of the capacity of the barrel, a feed amount of the dummy particle into the barrel is 10 to 70% by volume relative to the total of the feed amount of the fine particle to be plated and the feed amount of the dummy particle, and a volume of the mixture of the fine particle to be plated and the dummy particle fed into the barrel is 10 to 60% by volume of the capacity of the barrel.

* * * * *